US005984461A

United States Patent [19]

Faoro

[11] Patent Number: 5,984,461

[45] Date of Patent: Nov. 16, 1999

[54] INK RECEPTACLE FOR AN INKJET PRINTER OR INKJET PLOTTER

[75] Inventor: Francisco Faoro, Zurich, Switzerland

[73] Assignee: Pelikan Produktions AG, Switzerland

[21] Appl. No.: 09/039,963

[22] Filed: Mar. 16, 1998

[30] Foreign Application Priority Data

Mar. 17, 1997 [DE] Germany ..... 197 10 970

[51] Int. Cl.[6] ..... B41J 2/175

[52] U.S. Cl. ..... 347/86

[58] Field of Search ..... 347/85, 86, 87, 347/36; 206/320, 524.1, 524.3; 220/495.01

[56] References Cited

U.S. PATENT DOCUMENTS 4,695,824 9/1987 Tazaki ..... 347/86
5,727,878 3/1998 Sullivan, Jr. ..... 366/247

FOREIGN PATENT DOCUMENTS

0238829 A2 9/1987 European Pat. Off. .
0308796 A1 3/1989 European Pat. Off. .
8024472 U1 of 1980 Germany .
3238063 A1 4/1984 Germany .

*Primary Examiner*—N. Le
*Assistant Examiner*—Michael Nghiem
*Attorney, Agent, or Firm*—Fay, Sharpe, Fagan, Minnich & McKee, LLP

[57] ABSTRACT

An ink receptacle includes a housing (1) having a tub-shaped bottom part (2) and a lid (3). Around the periphery of an upper edge (16) of the tub (4) extends a circumferential groove (17). A port (8) sealed by a stopper (10) is defined in the bottom (7) of the tub (4) which is adapted to be pierced by a hollow needle. A tub-shaped membrane (18) is installed in the tub (4) and has, at its edge, a bulge (20) which is fitted with radial compression in groove (17). The lid (3) is snapped onto the bottom part (2) and has an interior wall (36) whose lower edge is pressed upon the bulge (20). In addition to the tub (4), the receptacle has another chamber (26) with an absorbent filling (28) for acceptance of residual ink. The receptacle has a large volumetric capacity and is specifically suitable for plotters or printers.

12 Claims, 1 Drawing Sheet

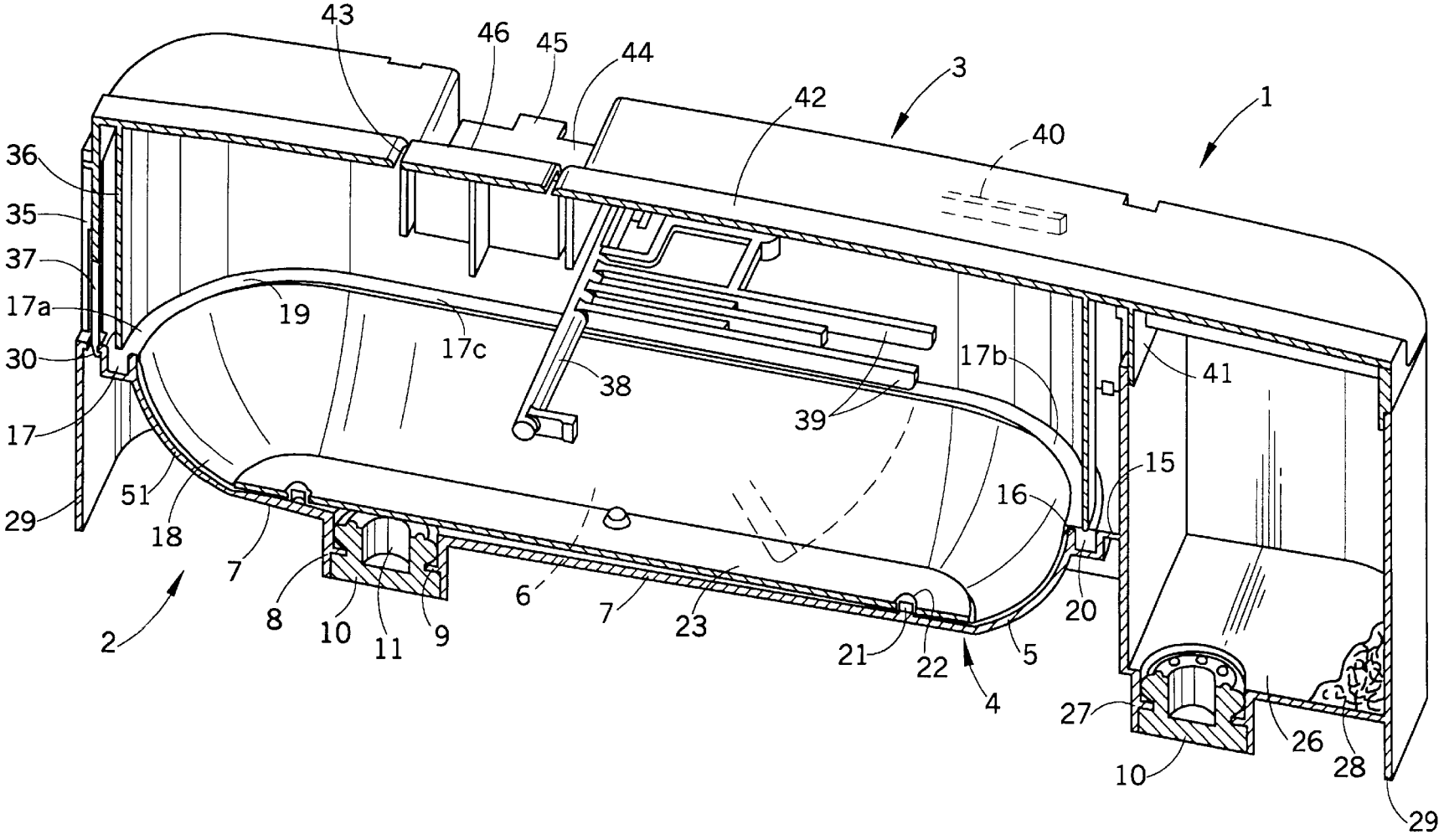
1
2
3
4
5
6
7
8
9
10
11
15
16
17
17a
17b
17c
18
19
20
21
22
23
26
27
28
29
30
35
36
37
38
39
40
41
42
43
44
45
46
51

INK RECEPTACLE FOR AN INKJET PRINTER OR INKJET PLOTTER

BACKGROUND OF THE INVENTION

The present invention relates to the art of ink supply systems for inkjet printers and plotters. It finds particular application in conjunction with a replaceable ink receptacle and will be described with particular reference thereto.

An inkjet print head with an ink receptacle is known from EP-A-238829. In one specific embodiment, the receptacle space is subdivided by a bladder into an ink storage space and an air space. The edge of the bladder is sealed against a cylindrical projection in the interior of the receptacle by means of a ring. This structure may be susceptible to ink leakage caused by exterior shocks or environmental changes.

The present invention contemplates a new and improved ink receptacle which overcomes the above-referenced problems and others.

SUMMARY OF THE INVENTION

In accordance with the present invention, a new and improved ink receptacle is provided. The ink receptacle includes a housing which has a bottom part that defines a tub. The tub includes a periphery edge which has a circumferential groove extending therealong. A port is defined in the tub and includes a first stopper disposed therein which is adapted to be pierced by a hollow needle of the printer. A tub-shaped elastomer membrane is received within the tub and has a peripheral edge which defines a bulge. The bulge is installed by radial compression in the groove. A lid closes the housing on the bottom part and has an inner wall whose lower edge is pressed on the bulge.

One advantage of the present invention is that it provides an improved manner of attaching and sealing a deformable ink reservoir to an ink housing.

The present invention is based on the object of providing an ink receptacle of the initially mentioned type, which has a large volumetric capacity and which is specifically suitable for an inkjet plotter. This object is solved by the combined characteristics of the present claims.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

The drawing shows a longitudinal cross-section through an ink receptacle in perspective representation in accordance with the present invention.

DETAILED DESCRIPTION OF THE PREFERRED EMBODIMENT

With reference to the drawing, a housing 1 of the receptacle has a bottom part 2 and a lid 3 of polypropylene. The lower part 2 has a tub 4, formed by two semi-spherical cup-shaped dishes 5, which verge laterally into two cylindrical dishes 6, and at the bottom into two slightly inclined, flat dishes 7. The dishes 7 are inclined toward a cylindrical, outside projecting pipe-shaped outlet port 8. The port 8 has an annular flange 9, projecting toward the inside, into which is snapped an elastomer stopper 10 of NBR (acryl-nitril-butadien-caoutchouc). The stopper 10 has on the inside a blind hole and serves for puncturing by a hollow needle of a printer or plotter to establish fluid communication between the receptacle 1 and a printer or plotter. The blind hole prevents that the needle can damage the below described membrane.

The upper edge 16 of the dishes 5 and 6 verges into a flat, horizontal wall 15, in which is formed immediately outside the upper edge 16 of the tub 4, a circumferential groove or connecting channel 17, having a rectangular cross-section. In bird's eye view, the groove 17 has two semi-circular (e.g., arc-shaped segments 17*a*, 17*b*. The groove 17 also has a first rectilinear segment 17*c* and a second rectilinear segment (now shown). In tub 4 is installed an elastomer, thin membrane 18 of NBR, which has, alongside its periphery, a flat segment 19 and a bulge or connecting member 20 formed thereon. The bulge 20 is substantially rectangularly shaped in cross-section and has on both sides circumferential projections, which are fitted, under pretension, in radially sealing fashion, between the two flanks of groove 17. The shape of membrane 18 corresponds to the shape of tub 4. The membrane 18 and the housing define an ink storage chamber. The flat bottom of the membrane 18 includes a plurality of top closed, hollow cones 21 which have an exterior ring edge 22. The cones 21 are snapped into passage bores of a plastic plate 23 which is adapted to the shape of the dishes 7.

Next to the tub, an additional chamber is formed in the lower part 2, which has, at the bottom a port 27 and a stopper 10 inserted therein. The chamber 26 is filled with a fluid absorbent material 28, for example cellulose, foam, fiber, or other material which serves for accepting the remainder or waste ink that is yielded during rinsing of the print head jets. A vertical wall 29 protrudes from the periphery of wall 15 and the outer walls of chamber 26 in downward direction and has a flat, lower edge. The wall 15 has between groove 17 and wall 29 several rectangular passage openings 30.

The lid 3 has an outer wall 35 and an inner wall 36. The contour of the inner wall 36 corresponds to the contour of the center line of groove 17. The inner wall 36 protrudes slightly beyond the outer wall 35. Its lower edge is pressed onto bulge 20 which assists in maintaining the bulge in the groove 17. Formed in the outer wall 35, in pairs, are several elastic tongues 37 which have hooks at the bottom. The hooks are snapped in at the underside of the openings 30. In two passage bores of the outer wall 35, an axle 38 is pivotably supported. A lever 39 projects out from the axle 38 and is pressed by a spring (not shown) against plate 23. In the FIGURE, the lever 39 is depicted in the upper extreme position. Between outer wall 35 and inner wall 36 there is formed, on the posterior side of the FIGURE, another longer lever 40. In the lower extreme position of lever 39, said lever 40 penetrates through a slot in the wall 15 beyond the lower edge of wall 29. This position is detected by a light barrier of the plotter and a signal is generated which indicates the end of the ink supply.

On the right, another circumferential wall 41 is formed at lid 3, which is pushed into the inside of chamber 26 and close same toward the top. The lid 3 has at the top an, in cross-section, U-shaped strip 42, with two unilaterally protruding slots 43 up to the center of strip 42. A formed-on, sunken, horizontal plate 44 between slots 43 has a tongue 45, protruding beyond the outer wall 35, for locking the receptacle 1 in the plotter. By pressing on a locking surface 46, the tongue 45 can be pulled back and the receptacle 1 removed.

For filling of ink, a hollow needle is inserted into stopper 10 and the space between membrane 18 and tub 4 is first evacuated. So that the air can be completely removed, two thin ribs 51 are formed at the tub 4, extending from the upper edge 16 in longitudinal direction up to the stub 8. After that, ink is filled in via the hollow needle until the membrane 18 is fully inverted. The receptacle can then be installed in the plotter, whereby, during installation, fixed needles in the plotter automatically pierce the stoppers 10 and ensure a connection.

The described design makes possible very high volumetric capacity of the ink receptacle. The radial compression of the bulge 20 and its horizontal projection shape of two semi-circular curvatures and two rectilinear segments provides secure sealing. Inasmuch as the bulge 20 is pressed from above through the lower edge of the inner wall 36 into the groove, it is not possible for this bulge, even in the event of knocks on the lid 3, to separate from groove 17 during transport. The combination of ink reservoir receptacle with chamber 26 for residual ink results in simple and safe operation of the plotter or printer, because with each receptacle change, a new ink residue chamber 26 with an unused absorbent body 28 is also automatically installed. By means of the inclination of the bottoms 7 and the ribs 51, the ink supply can be used up almost to the last drop. Plate 23 has the advantage that the membrane 18 inserts more uniformly toward the bottom and premature "empty" signals are avoided. The snap-in connection between lid 3 and bottom part 2 is a particularly rational solution. The pairing of polypropylene and NBR materials is suitable for many types of ink, specifically also for mineral oil-based inks which are employed, for example, for piezo-electric print heads. The receptacle can be produced with very thin walls, in other words cost-friendly.

Alternatively, instead of the ribs 51, recesses or grooves can also be formed in the tub 4. The ribs or grooves can also be formed onto the membrane 18. The lid 3 can also be pressed-on or welded-on to the bottom part 2.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An ink receptacle for an inkjet printer or inkjet plotter, comprising:

a housing having a bottom part defining a tub, the tub including a periphery edge having a circumferential groove extending therealong;

a port defined in the tub and including a first stopper disposed therein adapted to be pierced by a hollow needle of the printer or plotter;

a tub-shaped elastomer membrane received within the tub having a peripheral edge which defines a bulge, the bulge being compressed between side walls of the groove; and, a lid on the bottom part closing the housing and having a wall whose lower edge is pressed on the bulge.

2. The ink receptacle according to claim 1, further including a chamber including an opening which has a second stopper disposed therein, the chamber containing an absorbent material adapted for absorbing residual ink received from the printer.

3. The ink receptacle according to claim 1, wherein the groove includes two arc-shaped segments and two rectilinear segments.

4. The ink receptacle according to claim 1, wherein the lid is snapped on the bottom part.

5. The ink receptacle according to claim 1, further including a plate positioned on a center portion of the membrane which is fastened to the membrane.

6. The ink receptacle according to claim 1, further including:

a lever pivotally supported in the lid and having a free end resting upon the membrane or the plate and which is connected with an indicator element which projects beyond the housing when the ink receptacle is empty.

7. The ink receptacle according to claim 1, wherein the first stopper includes a blind hole.

8. The ink receptacle according to claim 1, wherein the lid includes a detachable locking element for engagement in the printer or plotter.

9. The ink receptacle according to claim 1, wherein on the tub or on the membrane there is formed at least one rib or groove, extending from the upper edge up to the first stopper.

10. The ink receptacle according to claim 1, wherein the membrane includes NBR.

11. An ink receptacle for an inkjet printers comprising:

a housing including a first wall having a connecting channel extending therealong;

an elastic member received within the housing having ends which define a connecting member, the connecting member being resiliently disposed within the connecting channel in a sealing engagement such that the elastic member and the housing define an ink storage chamber;

an outlet port defined in the housing in fluid communication with the ink storage chamber, the outlet port being sealed by a stopper which is pierceable by a needle from a printer to establish fluid communication therebetween; and, a lid for closing the housing, the lid including a second wall which engages the connecting member such that the connecting member is maintained within the connecting channel.

12. The ink receptacle according to claim 11, further including a waste ink chamber connected to the housing for receiving waste ink from a printer.

* * * * *